US009567813B2

(12) United States Patent
Fulda et al.

(10) Patent No.: US 9,567,813 B2
(45) Date of Patent: Feb. 14, 2017

(54) CORING TOOLS EXHIBITING REDUCED ROTATIONAL ECCENTRICITY AND RELATED METHODS

(71) Applicant: Baker Hughes Incorporated, Houston, TX (US)

(72) Inventors: Christian Fulda, Sehnde (DE); Thomas Uhlenberg, Niedersachsen (DE); Christoph Wesemeier, Hannover (DE)

(73) Assignee: Baker Hughes Incorporated, Houston, TX (US)

( * ) Notice: Subject to any disclaimer, the term of this patent is extended or adjusted under 35 U.S.C. 154(b) by 208 days.

(21) Appl. No.: 14/328,318

(22) Filed: Jul. 10, 2014

(65) Prior Publication Data

US 2016/0010401 A1 Jan. 14, 2016

(51) Int. Cl.

| | |
|---|---|
| ***E21B 17/10*** | (2006.01) |
| ***E21B 10/02*** | (2006.01) |
| ***E21B 25/10*** | (2006.01) |
| ***E21B 25/08*** | (2006.01) |

(52) U.S. Cl.

CPC ..... *E21B 17/1021* (2013.01); *E21B 10/02* (2013.01); *E21B 17/1014* (2013.01); *E21B 25/08* (2013.01); *E21B 25/10* (2013.01)

(58) Field of Classification Search

CPC ..... E21B 10/02; E21B 10/06; E21B 25/00; E21B 25/10; E21B 25/14; E21B 25/16; E21B 25/02; E21B 25/06; E21B 17/1021

See application file for complete search history.

(56) References Cited

U.S. PATENT DOCUMENTS

| | | | | |
|---|---|---|---|---|
| 4,502,553 | A * | 3/1985 | Park | E21B 25/06 166/228 |
| 4,598,777 | A * | 7/1986 | Park | E21B 25/08 175/226 |
| 4,606,417 | A | 8/1986 | Webb et al. | |
| 4,638,872 | A * | 1/1987 | Park | E21B 45/00 175/244 |
| 5,339,036 | A * | 8/1994 | Clark | E21B 17/1078 175/50 |
| 5,560,439 | A | 10/1996 | Delwiche et al. | |
| 5,836,406 | A | 11/1998 | Schuh | |

(Continued)

OTHER PUBLICATIONS

International Search Report for International Application No. PCT/US2015/039916, dated Sep. 30, 2015, 3 pages.

(Continued)

*Primary Examiner* — Yong-Suk (Philip) Ro
(74) *Attorney, Agent, or Firm* — TraskBritt

(57) ABSTRACT

Coring tools configured to procure core samples of earth formations may include a coring bit comprising a cutting structure configured to cut a core sample and an outer barrel connected to the coring bit. The outer barrel may be configured to apply axial and rotational force to the coring bit. An inner barrel may be located within the outer barrel and may be configured to receive a core sample within the inner barrel. A sponge material may line an inner surface of the inner barrel and may be configured to absorb a fluid from the core sample. A stabilizer may be connected to the outer barrel. At least one blade of the stabilizer may be rotatable with respect to the outer barrel and may be configured to remain at least substantially rotationally stationary relative to the earth formation during coring.

20 Claims, 3 Drawing Sheets

(56) References Cited

U.S. PATENT DOCUMENTS

| | | | | |
|---|---|---|---|---|
| 6,164,389 | A | 12/2000 | Fanuel et al. | |
| 6,719,070 | B1 * | 4/2004 | Puymbroeck | E21B 25/06 175/20 |
| 2002/0033281 | A1 | 3/2002 | Aumann et al. | |
| 2006/0169496 | A1 | 8/2006 | Puymbroeck et al. | |
| 2006/0238202 | A1 * | 10/2006 | Gorek | G01V 3/20 324/373 |
| 2009/0078467 | A1 * | 3/2009 | Castillo | E21B 25/10 175/249 |
| 2014/0166367 | A1 | 6/2014 | Campbell et al. | |

OTHER PUBLICATIONS

Written Opinion of the International Searching Authority for International Application No. PCT/US2015/039916, dated Sep. 30, 2015, 8 pages.

* cited by examiner

CORING TOOLS EXHIBITING REDUCED ROTATIONAL ECCENTRICITY AND RELATED METHODS

CROSS-REFERENCE TO RELATED APPLICATION

The subject matter of this application is related to the subject matter of U.S. Provisional Patent Application No. 61/847,911, filed Jul. 18, 2013, for "CORING TOOLS AND METHODS FOR MAKING CORING TOOLS AND PROCURING CORE SAMPLES," the disclosure of which is incorporated herein in its entirety by this reference.

FIELD

This disclosure relates generally to coring tools for procuring core samples of earth formations. More specifically, disclosed embodiments relate to coring tools including stabilizers that may increase the accuracy with which core samples procured using the coring tools reflect the actual characteristics of the earth formations from which the core sample were cut and reduce the likelihood that the core samples will become prematurely lodged within the coring tools.

BACKGROUND

When evaluating whether a given earth formation contains valuable materials, such as fluid hydrocarbons, a core sample of the earth formation may be procured. For example, a coring tool, which may include a coring bit configured to remove earth material around a columnar core sample, may be placed at the bottom of a borehole and rotated under load to form a core sample. As the coring tool advances, the core sample may be received into an inner barrel within the coring tool, which may be configured to contain the core sample during retrieval and reduce (e.g., minimize) contamination until the core sample can be analyzed. When the core sample is returned to the surface, the core sample, any fluids entrapped within the core sample, and any fluids that escaped the core sample but were captured by the coring tool may be analyzed to determine the characteristics exhibited by the earth formation.

To ensure that the core sample more accurately represents the actual characteristics of an earth formation at the end of a borehole, steps are taken to reduce the likelihood that contaminants enter the inner barrel that is to receive the core sample. For example, an entrance to the inner barrel may be sealed shut while advancing the coring tool into the borehole to reduce the likelihood that materials other than the core sample (e.g., drilling fluid and particles suspended within the drilling fluid) enter the inner barrel and contaminate the core sample. The entrance to the inner barrel may be sealed shut by, for example, an activation module that is intended to block the entrance to the inner barrel while the coring tool is advanced into the borehole and to unblock the entrance to the inner barrel when a core sample is introduced into the inner barrel. As a further example, the inner barrel may be substantially emptied of material and then filled, and potentially pressurized, with a presaturation fluid (i.e., a fluid of known composition that will not contaminate the core sample) before the coring tool is introduced into the borehole. The presaturation fluid may be selected such that a sponge material lining the interior of the inner barrel is not wettable by the presaturation fluid. The sponge material, however, may be a material that is wettable by a fluid of interest expected to be found within the core sample, such as oil or other hydrocarbons.

BRIEF SUMMARY

In some embodiments, coring tools configured to procure core samples of earth formations may include a coring bit comprising a cutting structure configured to cut a core sample and an outer barrel connected to the coring bit. The outer barrel may be configured to apply axial and rotational force to the coring bit. An inner barrel may be located within the outer barrel and may be configured to receive a core sample within the inner barrel. A sponge material may line an inner surface of the inner barrel and may be configured to absorb a fluid from the core sample. A stabilizer may be connected to the outer barrel. At least one blade of the stabilizer may be rotatable with respect to the outer barrel and may be configured to remain at least substantially rotationally stationary relative to the earth formation during coring.

In other embodiments, methods of procuring core samples of earth formations utilizing coring tools may involve positioning a coring bit connected to an outer barrel within a borehole. The coring bit may include a cutting structure configured to cut a core sample, and the outer barrel may be configured to apply axial and rotational force to the coring bit. The outer barrel and coring bit may be rotated under load to advance the coring bit into an underlying earth formation and form a core sample. At least a portion of the core sample may be received within an inner barrel located within the outer barrel as the inner barrel remains at least substantially rotationally stationary relative to the earth formation. The inner barrel may include a sponge material lining an inner surface of the inner barrel, the sponge material being configured to absorb a fluid from the core sample. The coring tool may be stabilized utilizing a stabilizer connected to the outer barrel as at least one blade of the stabilizer remains at least substantially rotationally stationary relative to the earth formation during coring.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular stabilizer, coring tool, or component thereof, but are merely idealized representations employed to describe illustrative embodiments. Thus, the drawings are not necessarily to scale.

Disclosed embodiments relate generally to coring tools including stabilizers that may increase the accuracy with which a core sample procured using the coring tools reflects the actual characteristics of the earth formation from which the core sample was cut, and that may reduce the likelihood that the core sample will become prematurely lodged within the coring tool. More specifically, disclosed are embodiments of stabilizers for coring tools that may reduce rotational eccentricity of coring bits or tools, resulting in core samples being cut more smoothly and closer to their intended diameter.

Figure 1:
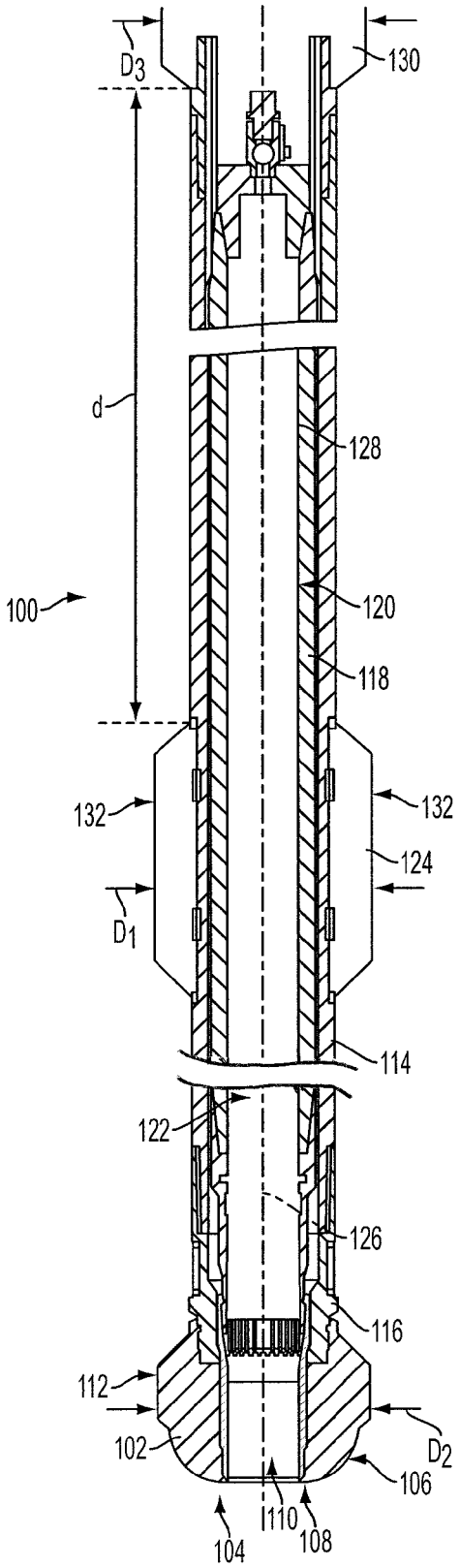
FIG. 1 is a cross-sectional side view of a coring tool for procuring a core sample of an earth formation.

Referring to FIG. 1, a cross-sectional side view of a coring tool 100 for procuring a core sample of an earth formation is shown. The coring tool 100 may include a coring bit 102 at a lowest longitudinal end 104 of the coring tool 100. The coring bit 102 may include a cutting structure 106 configured to cut a core sample from an earth formation. The cutting structure 106 may be, for example, a set of radially and longitudinally extending blades projecting from a remainder of the coring bit 102 with cutting elements secured to the blades or a matrix material impregnated with abrasive cutting particles. The cutting structure 106 may include an inner gage 108 surrounding a central cavity 110 within the coring bit 102. The cutting structure 106 may be configured to cut around a periphery of a core sample, and the central cavity 110 may be configured to receive the core sample as the coring bit 102 is advanced into the earth formation. The cutting structure 106 may further include an outer gage 112 defining a radially outermost portion of the coring bit 102. The outer gage 112 may be configured to cut a sidewall of a wellbore being drilled by the coring tool 100 as a core sample is taken.

The coring tool 100 may further include an outer barrel 114 connected to the coring bit 102. The outer barrel 114 may be configured to apply axial and rotational force to the coring bit 102 when forming a core sample. For example, the outer barrel 114 may be attached to a drill string proximate a lowest longitudinal end of the drill string, and axial and rotational force may be applied to the drill string and transmitted to the coring bit 102. The outer barrel 114 may be, for example, a tubular member extending longitudinally above the coring bit 102. The outer barrel 114 may be physically secured to the coring bit 102 by, for example, a shank 116 interposed between and attached to the outer barrel 114 and the coring bit 102.

An inner barrel 118 may be located within the outer barrel 114. The inner barrel 118 may be configured to receive a core sample within the inner barrel 118 for storage and preservation as the coring tool 100 is retrieved from a wellbore. The inner barrel 118 may be, for example, a tubular member connected to the outer barrel 114 in a manner allowing the inner barrel 118 to remain rotationally stationary while the outer barrel 114 rotates around the inner barrel 118. An inner surface 120 of the inner barrel 118 may surround a central bore 122 into which a core sample may be received as the coring tool 100 is advanced into an earth formation.

A sponge material 128 may line the inner surface 120 of the inner barrel 118. The sponge material 128 may be configured of a material selected to absorb a fluid expected to be found within the core sample, such as, for example, hydrocarbons (e.g., oil). The sponge material 128 may be, for example, a porous body characterized by an open network of pores into which fluid may infiltrate. The sponge material 128 may be, for example, a foam (e.g., a polyurethane foam), felt, or any other material into which fluids may infiltrate (e.g., using capillary action to draw the fluid into the material), which may be preferentially wetted by hydrocarbons, such as oil. In embodiments where the sponge material 128 exhibits preferential wettability to hydrocarbons such as oil, the sampling of fluids within the sponge material 128 after procuring a core sample may more accurately reflect the concentration of a particular fluid of interest. The sponge material 128 may be provided, for example, in sections that are individually inserted into the inner barrel 118 and attached to the inner barrel 118 adjacent to one another until they line an entire longitudinal length of the inner barrel 118 above a selected point.

In accordance with embodiments of the present disclosure, the coring tool 100 may include a stabilizer 124 located within a longitudinal extent of the coring tool 100. For example, the stabilizer 124 may be located within a bottom half of a longitudinal extent of the coring tool 100. More specifically, the stabilizer 124 may be located within a bottom third of the longitudinal extent of the coring tool 100. As another example, the stabilizer 124 may be located within an upper half of the longitudinal extent of the coring tool 100.

The stabilizer 124 may be rotatably connected to the outer barrel 114. In other words, the stabilizer 124 may be connected to the outer barrel 114 in a manner that enables the stabilizer 124 to remain at least substantially, rotationally stationary while the outer barrel 114 and coring bit 102 rotate during a coring process. The stabilizer 124 may be configured to reduce eccentric rotation of the coring bit 102. When the coring bit 102 is rotated within a wellbore, the coring bit 102 may tend to rotate about an axis of rotation that is offset from a longitudinal axis 126 extending along a radial centerline of the coring tool 100. For example, imbalanced cutting forces acting on the cutting structure 106, earth formations of varying compositions being impacted by different portions of the cutting structure 106, and misaligned axial forces acting on the coring bit 102 may cause the coring bit 102 to rotate unintentionally about an axis of rotation that is offset from the longitudinal axis 126 of the coring tool 100. Eccentric rotation of the coring bit 102 may cause the inner gage 108 of the cutting structure 106 to cut a core sample that is significantly smaller in diameter than desired, leaving a larger-than-intended annular space between a periphery of the core sample and the sponge material 128 lining the inner surface 120 of the inner barrel 118. Fluids escaping from the core sample may travel axially along the annular space, eventually being captured by the sponge material 128 at a different longitudinal position or escaping the inner barrel 118 to circulate with drilling fluid pumped downhole to lubricate, cool, and remove cuttings from the coring tool 100. In other words, eccentric rotation of the coring bit 102 may result less in an accurate representation of both local and total earth formation characteristics. The stabilizer 124 may be configured to reduce eccentric rotation of the coring bit 102. For example, the stabilizer 124 may press against the wall of a borehole to counteract the tendency of the coring bit 102 to rotate eccentrically. In addition, the stabilizer 124 may reduce lateral vibrations and other lateral movements (i.e., vibrations and movements in a direction at least substantially perpendicular to the longitudinal axis 126), which may enable use of a sponge 128 exhibiting a small inner diameter to increase efficiency and accuracy of fluid capture by the sponge 128.

In some embodiments, another stabilizer 130 may be connected to the drill string to which the coring bit 102 is connected, the other stabilizer 130 being located longitudinally farther from the coring bit 102 than the stabilizer 124. For example, the other stabilizer 130 may be located above a longitudinal upper extent of the coring tool 100. The other stabilizer 130 may be configured to further reduce eccentric rotation of the coring bit 102, lateral vibration of the coring bit 102, and other lateral movement of the coring bit 102. The other stabilizer 130 may be configured in a manner at least substantially similar to the stabilizer 124, with differences between the stabilizers 124 and 130 in certain embodiments being discussed in greater detail below.

Figure 2:
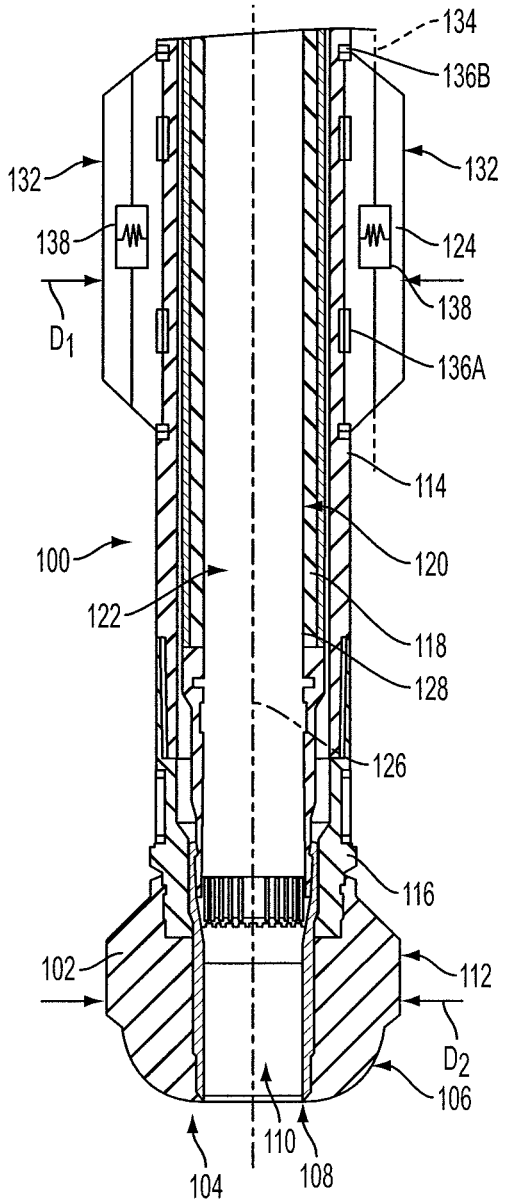
FIG. 2 is an enlarged cross-sectional side view of a portion of the coring tool of FIG. 1.

Referring to FIG. 2, an enlarged cross-sectional side view of a portion of the coring tool 100 of FIG. 1 is shown. The stabilizer 124 may include longitudinally and radially extending blades 132 configured to contact and ride on a wall of a borehole. The blades 132 of the stabilizer 124 may extend longitudinally at least substantially parallel (i.e., parallel within manufacturing tolerances) to the longitudinal axis 126 of the coring tool 100, which may enable detritus suspended within drilling fluid to more easily flow past the blades 132 and reduce adhesion, accumulation, and balling of formation cuttings on the blades 132. More specifically, a central axis 134 geometrically equidistant from the lateral ends of each blade 132 may be at least substantially parallel to the longitudinal axis 126 of the coring tool 100. Orienting the blades 132 at least substantially parallel to the longitudinal axis 126 of the coring tool 100 may further reduce the likelihood that the stabilizer 124 will contact and become lodged against borehole outcroppings when travelling axially along the borehole because the periphery of the blades 132 does not extend around an entire circumference of the stabilizer 124, leaving gaps through which such outcroppings may pass.

An outer diameter $D_1$ of the stabilizer 124 may be, for example, at least substantially equal to an outer diameter $D_2$ of the coring bit 102 at the outer gage 112, which may enable the stabilizer 124 to better reduce eccentric rotation of the coring bit 102. The outer diameter $D_1$ of the stabilizer 124 may be equal to the outer diameter $D_2$ of the coring bit 102 at the outer gage 112 in some embodiments. In other embodiments, the outer diameter $D_1$ of the stabilizer 124 may be less than the outer diameter $D_2$ of the coring bit 102 at the outer gage 112. For example, the outer diameter $D_1$ of the stabilizer 124 may be between about 98% and about 100% of the outer diameter $D_2$ of the coring bit 102 at the outer gage 112. More specifically, the outer diameter $D_1$ of the stabilizer 124 may be, for example, between about 99% and about 100% (e.g., about 100%) of the outer diameter $D_2$ of the coring bit 102 at the outer gage 112. As another example, the outer diameter $D_1$ of the stabilizer 124 may within about 0.125 inch (~3.2 mm) of the outer diameter $D_2$ of the coring bit 102 at the outer gage 112. More specifically, the outer diameter $D_1$ of the stabilizer 124 may be, for example, about 0.04 inch (~1.0 mm) or less (e.g., about 0.02 inch (~0.5 mm)) smaller than the outer diameter $D_2$ of the coring bit 102 at the outer gage 112. As yet another example, the outer diameter $D_1$ of the stabilizer 124 may between about 8.46 inches (21.49 cm) and about 8.5 inches (21.59 cm). More specifically, the outer diameter $D_1$ of the stabilizer 124 may be, for example, between about 8.48 inches (21.53 cm) and about 8.5 inches (21.59 cm) (e.g., about 8.49 inches (21.56 cm)).

The stabilizer 124 may include bearings 136 configured to transmit radial and axial loads between the stabilizer 124 and the outer barrel 114 while enabling the stabilizer 124 to remain at least substantially rotationally stationary while the outer barrel 114 rotates. For example, the stabilizer 124 may include radial bearings 136A (e.g., concentric annular members including rubbing bearing surfaces or ball bearings) extending around a circumference of the outer barrel 114 and axial bearings 136B (e.g., longitudinally stacked annular members including rubbing bearing surfaces or ball or roller bearings) at upper and lower ends of the stabilizer 124.

In some embodiments, the blades 132 of the stabilizer 124 may be extensible to maintain contact against a wall of a borehole, and may even actively press against the wall of the borehole. For example, the blades 132 may include an extension mechanism 138 enabling the blades 132 to extend and retract radially to maintain contact against a wall of a borehole. The extension mechanism 138 may be, for example, a spring-loaded bias or an electronically-controlled hydraulic or mechanical drive system configured to extend the blades 132 radially outward to maintain contact against the wall of a borehole.

In some embodiments, the stabilizer 124 may be located proximate the lowest longitudinal end 104 of the coring tool 100, while remaining longitudinally above the coring bit 102, which proximity may enable the stabilizer 124 to better reduce eccentric rotation of the coring bit 102. When it is said that the stabilizer 124 may be located "proximate" the lowest longitudinal end 102 of the coring tool 100, what is meant is that the stabilizer 124 is the next direct component in the drill string connected to the coring bit 102 (e.g., on the outer barrel 114), or the next component in the drill string after a shank 116 between the stabilizer 124 and the coring bit 102. For example, the stabilizer 124 may be located about 5 feet (~1.5 m) or less from the lowest longitudinal end 104 of the coring tool 100. More specifically, the stabilizer 124 may be located about 2 feet (~0.6 m) or less (e.g., about 1 foot (~0.3 m) or less) from the lowest longitudinal end 104 of the coring tool 100.

Returning to FIG. 1, the other stabilizer 130 may be of at least substantially the same design and dimensions as the stabilizer 124 in some embodiments. For example, an outer diameter $D_3$ of the other stabilizer 130 may be at least substantially equal to the outer diameter $D_2$ of the coring bit 102 at the outer gage 112. More specifically, the outer diameter $D_3$ of the other stabilizer 130 may be equal to the outer diameter $D_1$ of the stabilizer 124. In other embodiments, the other stabilizer 130 may be different from the stabilizer 124. For example, the outer diameter $D_3$ of the other stabilizer 130 may be less than the outer diameter $D_2$ of the coring bit 102 at the outer gage 112. More specifically, the outer diameter $D_3$ of the other stabilizer 130 may be less than the outer diameter $D_1$ of the stabilizer 124. As a specific, nonlimiting example, the outer diameter $D_3$ of the other stabilizer 130 may be between about 0.1 inch (~2.5 mm) and about 1.0 inch (~25.4 mm) (e.g., about 0.5 inch (~12.7 mm)) less than the outer diameter $D_1$ of the stabilizer 124.

A distance d between the stabilizer 124 and the other stabilizer 130 may be about 50 feet (~15.2 m) or less. For example, the longitudinal distance d between the stabilizer 124 and the other stabilizer 130 may be about 30 feet (~9.1 m) or less. More specifically, the longitudinal distance d between the stabilizer 124 and the other stabilizer 130 may be between about 10 feet (~3.0 m) and about 20 feet (~6.1 m) (e.g., about 15 feet (~4.6 m)). A distance between the stabilizer 124 and an upper extent of the coring tool 100 may be, for example, less than 30 feet (~9.1 m). More specifically, the distance between the stabilizer 124 and the upper extent of the coring tool 100 may be less than 10 feet (~3.0 m). As a specific, nonlimiting example, the distance between the stabilizer 124 and the upper extent of the coring tool 100 may be less than 5 feet (~1.5 m).

In some embodiments, the other stabilizer 130 may be rotatable with respect to the coring bit 102 such that the other stabilizer 130 may remain rotationally stationary while the coring bit 102 rotates. In other embodiments, the other stabilizer 130 may not be rotatable with respect to the coring bit 102 such that rotation of the drill string to rotate coring bit 102 results in corresponding synchronous rotation of the other stabilizer 130.

Figure 3:
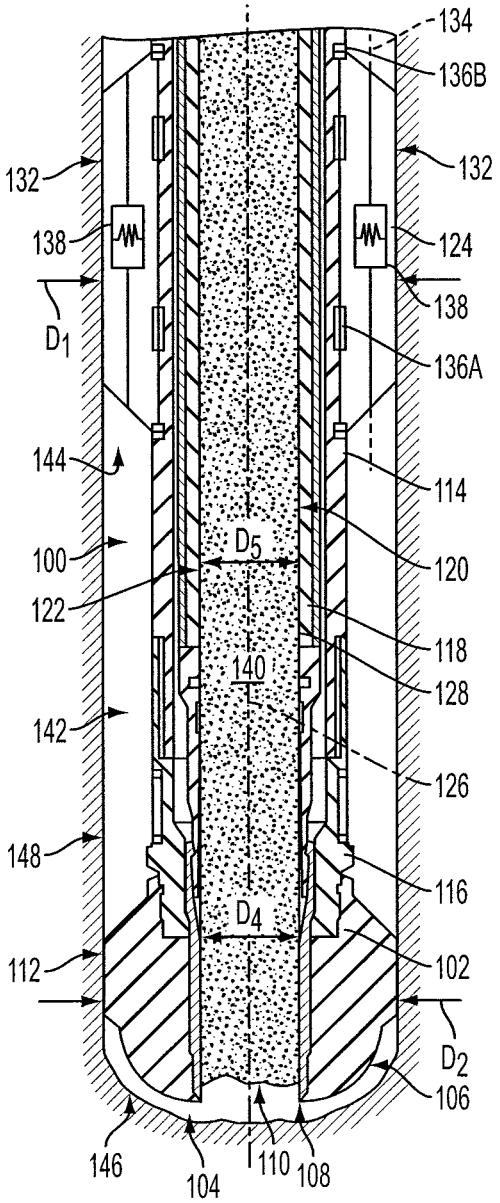
FIG. 3 is another enlarged cross-sectional view of the portion of the coring tool of FIG. 1 after procuring a core sample.

Referring to FIG. 3, another enlarged cross-sectional view of the portion of the coring tool 100 of FIG. 1 is shown after procuring a core sample 140. The coring tool 100 may be introduced into a borehole 142 and positioned at a bottom of the borehole 142. Axial and rotational force may be applied to a drill string 144 of which the coring tool 100 is a part, and the coring bit 102 may rotate and be driven into the underlying earth formation 146. The cutting structure 106 may cut and remove earth material surrounding a central, columnar core sample 140, which may be received into the central bore 122 of the inner barrel 118 as the coring tool 100 advances.

The stabilizer 124, and the other stabilizer 130 (see FIG. 1) in some embodiments, may remain rotationally stationary as the coring bit 102 rotates. Blades 132 of the stabilizer 124 may remain in contact with a wall 148 of the borehole 142. The blades 132 may remain rotationally stationary and may slide longitudinally along the wall 148 of the borehole 142 as the coring tool 100 advances axially to cut the core sample 140 from the underlying earth formation 146. The blades 132 of the stabilizer 124 may remain in contact with the wall 148 of the borehole 142. For example, in embodiments where the stabilizer 124 includes an extension mechanism 138, the blades 132 may extend radially outward to contact, and may press against, the wall 148 of the borehole 142. As the coring bit 102 is urged to wander, tending to misalign the axis of rotation of the coring bit 102 from the longitudinal axis 126 of the coring tool 100, the stabilizer 124 may counteract forces urging the coring bit 102 to wander, reducing eccentricity of rotation of the coring bit 102.

The exterior surface of the resulting core sample 140 may be located closer to the sponge material 128 lining the inner surface 120 of the inner barrel 118. For example, a diameter $D_4$ of the core sample 140 may be closer to the diameter $D_5$ of the central bore 122. More specifically, the diameter $D_4$ of the core sample 140 may about 0.08 inch (~2.0 mm) (e.g., of a radius about 0.04 inch (~1.0 mm)) smaller than the diameter $D_5$ of the central bore 122. Reducing the size of a gap between the core sample 140 and the sponge material 128 may enable the sponge material 128 to capture a greater proportion of fluid escaping from the core sample 140 and to capture that fluid proximate the longitudinal location along the length of the core sample 140 from which the fluid escaped, causing the core sample 140 and the fluid captured from the core sample 140 to more accurately reflect the local and total characteristics of the downhole earth formation 146.

Additional, illustrative embodiments encompassed by this disclosure include the following:

Embodiment 1: A coring tool configured to procure a core sample of an earth formation, comprising: a coring bit comprising a cutting structure configured to cut a core sample; an outer barrel connected to the coring bit, the outer barrel configured to apply axial and rotational force to the coring bit; an inner barrel located within the outer barrel, the inner barrel being configured to receive a core sample within the inner barrel; a sponge material lining an inner surface of the inner barrel, the sponge material being configured to absorb a fluid from the core sample; and a stabilizer connected to the outer barrel, at least one blade of the stabilizer being rotatable with respect to the outer barrel and configured to remain at least substantially rotationally stationary relative to the earth formation during coring, the stabilizer located adjacent to the coring bit.

Embodiment 2: The coring tool of Embodiment 1, wherein the outer diameter of the stabilizer is less than the outer diameter of the coring bit at the outer gage of the cutting structure.

Embodiment 3: The coring tool of Embodiment 2, wherein the outer diameter of the stabilizer is about 0.125 inch or less smaller than the outer diameter of the coring bit at the outer gage of the cutting structure.

Embodiment 4: The coring tool of Embodiment 3, wherein the outer diameter of the stabilizer is about 0.04 inch or less smaller than the outer diameter of the coring bit at the outer gage of the cutting structure.

Embodiment 5: The coring tool of any one of Embodiments 2 through 4, wherein the outer diameter of the stabilizer is between about 98% and about 100% of the outer diameter of the coring bit at the outer gage.

Embodiment 6: The coring tool of Embodiment 5, wherein the outer diameter of the stabilizer is between about 99% and about 100% of the outer diameter of the coring bit at the outer gage.

Embodiment 7: The coring tool of any one of Embodiments 1 through 6, wherein blades of the stabilizer extend at least substantially parallel to a longitudinal axis of the coring tool.

Embodiment 8: The coring tool of any one of Embodiments 1 through 7, wherein blades of the stabilizer are extensible to reduce the distance between the surface of the blade and the wall of the borehole.

Embodiment 9: The coring tool of any one of Embodiments 1 through 8, wherein the stabilizer is located within a longitudinal extent of the coring tool.

Embodiment 10: The coring tool of Embodiment 9, wherein the stabilizer is located in a lower half of the coring tool.

Embodiment 11: The coring tool of Embodiment 10, wherein the stabilizer is located in a lower third of the coring tool.

Embodiment 12: The coring tool of any one of Embodiments 9 through 11, wherein the stabilizer is located about 2 feet or less from a lowest longitudinal end of the coring tool.

Embodiment 13: The coring tool of any one of Embodiments 1 through 12, wherein a shank is connected directly to the coring bit and the stabilizer is connected directly to the shank.

Embodiment 14: The coring tool of Embodiment 9, wherein the stabilizer is located in an upper half of the coring tool.

Embodiment 15: The coring tool of any one of Embodiments 1 through 9, wherein the stabilizer located above a longitudinal extent of the coring tool.

Embodiment 16: The coring tool of Embodiment 15, wherein a distance between the stabilizer and an upper extent of the coring tool is less than 30 feet.

Embodiment 17: The coring tool of Embodiment 16, wherein the distance between the stabilizer and the upper extent of the coring tool is less than 10 feet.

Embodiment 18: The coring tool of any one of Embodiments 1 through 13, further comprising another stabilizer connected to a drill string to which the coring bit is connected, the other stabilizer being located longitudinally farther from the coring bit than the stabilizer.

Embodiment 19: The coring tool of Embodiment 18, wherein an outer diameter of the other stabilizer is less than the outer diameter of the coring bit at the outer gage of the cutting structure.

Embodiment 20: The coring tool of Embodiment 18, wherein the outer diameter of the other stabilizer is at least substantially equal to the outer diameter of the stabilizer.

Embodiment 21: The coring tool of any one of Embodiments 18 through 20, wherein a distance between the stabilizer and the other stabilizer is about 50 feet or less.

Embodiment 22: The coring tool of Embodiment 21, wherein the distance between the stabilizer and the other stabilizer is about 30 feet or less.

Embodiment 23: The coring tool of any one of Embodiments 18 through 22, wherein the other stabilizer is rotatable with respect to the coring bit.

Embodiment 24: The coring tool of any one of Embodiments 18 through 23, wherein at least one blade of the other stabilizer is rotatable with respect to the outer barrel.

Embodiment 25: A method of procuring a core sample of an earth formation utilizing a coring tool, comprising: positioning a coring bit connected to an outer barrel within a borehole, the coring bit comprising a cutting structure configured to cut a core sample, the outer barrel configured to apply axial and rotational force to the coring bit; rotating the outer barrel and coring bit under load to advance the coring bit into an underlying earth formation and form a core sample; receiving at least a portion of the core sample within an inner barrel located within the outer barrel as the inner barrel remains at least substantially rotationally stationary relative to the earth formation, the inner barrel including a sponge material lining an inner surface of the inner barrel, the sponge material being configured to absorb a fluid from the core sample; and stabilizing the coring tool utilizing a stabilizer connected to the outer barrel adjacent to the coring bit as at least one blade of the stabilizer remains at least substantially rotationally stationary relative to the earth formation during coring.

Embodiment 26: The method of Embodiment 25, wherein stabilizing the coring tool utilizing the stabilizer comprises stabilizing the coring tool utilizing the stabilizer, an outer diameter of the stabilizer being less than an outer diameter of the coring bit at the outer gage of the cutting structure.

Embodiment 27: The method of Embodiment 26, wherein stabilizing the coring tool utilizing the stabilizer, the outer diameter of the stabilizer being less than the outer diameter of the coring bit at the outer gage of the cutting structure, comprises stabilizing the coring tool utilizing the stabilizer, the outer diameter of the stabilizer being about 0.125 inch or less smaller than the outer diameter of the coring bit at the outer gage of the cutting structure.

Embodiment 28: The method of Embodiment 27, wherein stabilizing the coring tool utilizing the stabilizer, the outer diameter of the stabilizer being about 0.125 inch or less smaller than the outer diameter of the coring bit at the outer gage of the cutting structure comprises stabilizing the coring tool utilizing the stabilizer, the outer diameter of the stabilizer being about 0.04 inch or less smaller than the outer diameter of the coring bit at the outer gage of the cutting structure.

Embodiment 29: The method of Embodiment 26, wherein stabilizing the coring tool utilizing the stabilizer, the outer diameter of the stabilizer being less than the outer diameter of the coring bit at the outer gage of the cutting structure, comprises stabilizing the coring tool utilizing the stabilizer, the outer diameter of the stabilizer being between about 98% and about 100% of the outer diameter of the coring bit at the outer gage.

Embodiment 30: The method of Embodiment 29, wherein stabilizing the coring tool utilizing the stabilizer, the outer diameter of the stabilizer being between about 98% and about 100% of the outer diameter of the coring bit at the outer gage, comprises stabilizing the coring tool utilizing the stabilizer, the outer diameter of the stabilizer being between about 99% and about 100% of the outer diameter of the coring bit at the outer gage.

Embodiment 31: The method of any one of Embodiments 25 through 30, further comprising flowing drilling fluid between blades of the stabilizer, the blades extending at least substantially parallel to a longitudinal axis of the coring tool.

Embodiment 32: The method of any one of Embodiments 25 through 31, further comprising selectively, radially extending the at least one blade of the stabilizer to reduce a distance between the at least one blade and a wall of the borehole.

Embodiment 33: The method of any one of Embodiments 25 through 32, wherein stabilizing the coring tool utilizing the stabilizer connected to the outer barrel adjacent to the coring bit comprises stabilizing the coring tool utilizing the stabilizer directly connected to a shank directly connected to the coring bit.

Embodiment 34: The method of any one of Embodiments 25 through 33, further comprising maintaining contact between blades of the stabilizer and a wall of a borehole by selectively, radially extending and retracting the blades of the stabilizer.

Embodiment 35: The method of any one of Embodiments 25 through 34, wherein stabilizing the coring tool utilizing the stabilizer comprises stabilizing the coring tool utilizing the stabilizer located within a longitudinal extent of the coring tool.

Embodiment 36: The method of Embodiment 35, wherein stabilizing the coring bit utilizing the stabilizer rotatably connected to the outer barrel proximate the coring bit comprises stabilizing the coring bit utilizing the stabilizer rotatably connected to the outer barrel about 2 feet or less from a lowest longitudinal end of the coring tool.

Embodiment 37: The method of any one of Embodiments 25 through 32 and 34, wherein stabilizing the coring tool utilizing the stabilizer comprises stabilizing the coring tool utilizing the stabilizer located above a longitudinal extent of the coring tool.

Embodiment 38: The method of any one of Embodiments 25 through 37, further comprising stabilizing the coring bit utilizing another stabilizer connected to a drill string to which the coring bit is connected, the other stabilizer being located longitudinally farther from the coring bit that the stabilizer.

Embodiment 39: The method of Embodiment 38, wherein stabilizing the coring bit utilizing the other stabilizer connected to the drill string comprises stabilizing the coring bit utilizing the other stabilizer, an outer diameter of the other stabilizer being less than the outer diameter of the coring bit at the outer gage of the cutting structure.

Embodiment 40: The method of Embodiment 39, wherein stabilizing the coring bit utilizing the other stabilizer to the drill string comprises stabilizing the coring bit utilizing the other stabilizer, the outer diameter of the other stabilizer being at least substantially equal to the outer diameter of the stabilizer.

Embodiment 41: A method of making a coring tool for procuring a core sample of an earth formation, comprising:

connecting an outer barrel to a coring bit, the coring bit comprising a cutting structure configured to cut a core sample, the outer barrel configured to apply axial and rotational force to the coring bit; positioning an inner barrel within the outer barrel, the inner barrel being configured to receive a core sample within the inner barrel, the inner barrel including a sponge material lining an inner surface of the inner barrel, the sponge material being configured of a material selected to absorb a fluid expected to be found within the core sample; and rotatably connecting a stabilizer to the outer barrel proximate the coring bit, the stabilizer being configured to rotate with respect to the coring bit and remain at least substantially rotationally stationary relative to the earth formation during coring, an outer diameter of the stabilizer being at least substantially equal to an outer diameter of the coring bit at an outer gage of the cutting structure.

Embodiment 42: The coring tool of Embodiment 41, wherein connecting the stabilizer to the outer barrel comprises selecting the outer diameter of the stabilizer to be less than the outer diameter of the cutting bit at the outer gage of the cutting structure.

Embodiment 43: The coring tool of Embodiment 41 or Embodiment 42, wherein rotatably connecting the stabilizer to the outer barrel comprises orienting blades of the stabilizer to extend at least substantially parallel to a longitudinal axis of the coring tool.

Embodiment 44: The coring tool of any one of Embodiments 41 through 43, wherein rotatably connecting the stabilizer to the outer barrel comprises configuring blades of the stabilizer to be extensible to maintain contact against a wall of a borehole.

Embodiment 45: The coring tool of any one of Embodiments 41 through 44, wherein rotatably connecting the stabilizer to the outer barrel comprises positioning the stabilizer about 2 feet or less from a lowest longitudinal end of the coring tool.

Embodiment 46: The coring tool of any one of Embodiments 41 through 45, further comprising connecting another stabilizer to a drill string to which the coring bit is connected, the other stabilizer being located longitudinally farther from the coring bit than the stabilizer.

Embodiment 47: The coring tool of Embodiment 46, wherein connecting the other stabilizer to the drill string comprises selecting an outer diameter of the other stabilizer to be at least substantially equal to the outer diameter of the coring bit at the outer gage of the cutting structure.

Embodiment 48: The coring tool of Embodiment 47, wherein connecting the other stabilizer to the drill string comprises selecting the outer diameter of the other stabilizer to be less than the outer diameter of the stabilizer.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A coring tool configured to procure a core sample of an earth formation, comprising:

a coring bit comprising a cutting structure configured to cut a core sample;

an outer barrel connected to the coring bit, the outer barrel configured to apply axial and rotational force to the coring bit;

an inner barrel located within the outer barrel, the inner barrel being configured to receive the core sample within the inner barrel;

a sponge material lining an inner surface of the inner barrel, the sponge material being configured to absorb a fluid from the core sample; and a stabilizer connected to the outer barrel, at least one blade of the stabilizer being rotatable with respect to the outer barrel and configured to remain at least substantially rotationally stationary relative to the earth formation during coring.

2. The coring tool of claim 1, wherein an outer diameter of the stabilizer is about 0.125 inch or less smaller than an outer diameter of the coring bit at an outer gage of the cutting structure.

3. The coring tool of claim 1, wherein the at least one blade of the stabilizer extends at least substantially parallel to a longitudinal axis of the coring tool.

4. The coring tool of claim 1, wherein the at least one blade of the stabilizer is extensible to reduce the distance between the surface of the at least one blade and a wall of a borehole.

5. The coring tool of claim 1, wherein the stabilizer is integrated into the outer barrel of the coring tool, such that the stabilizer is located within a longitudinal extent of the outer barrel of the coring tool.

6. The coring tool of claim 5, wherein the stabilizer is located in a lower half of the coring tool.

7. The coring tool of claim 6, wherein the stabilizer is located in a lower third of the coring tool.

8. The coring tool of claim 5, wherein the stabilizer is located in an upper half of the coring tool.

9. The coring tool of claim 1, wherein the stabilizer forms part of a distinct sub attached to the coring tool, such that the stabilizer is located above a longitudinal extent of the coring tool.

10. The coring tool of claim 9, wherein a distance between the stabilizer and an upper extent of the coring tool is less than 30 feet.

11. The coring tool of claim 10, wherein the distance between the stabilizer and the upper extent of the coring tool is less than 10 feet.

12. The coring tool of claim 1, further comprising another stabilizer connected to the outer barrel, wherein a distance between the stabilizer and the another stabilizer is about 50 feet or less.

13. The coring tool of claim 12, wherein the distance between the stabilizer and the another stabilizer is about 30 feet or less.

14. The coring tool of claim 12, wherein the at least one blade of the another stabilizer is rotatable with respect to the outer barrel.

15. A method of procuring a core sample of an earth formation utilizing a coring tool, comprising:

positioning a coring bit connected to an outer barrel within a borehole, the coring bit comprising a cutting structure configured to cut a core sample, the outer barrel configured to apply axial and rotational force to the coring bit;

rotating the outer barrel and coring bit under load to advance the coring bit into an underlying earth formation and form the core sample;

receiving at least a portion of the core sample within an inner barrel located within the outer barrel as the inner barrel remains at least substantially rotationally stationary relative to the earth formation, the inner barrel including a sponge material lining an inner surface of the inner barrel, the sponge material being configured to absorb a fluid from the core sample; and stabilizing the coring tool utilizing a stabilizer connected to the outer barrel as at least one blade of the stabilizer remains at least substantially rotationally stationary relative to the earth formation during coring.

16. The method of claim 15, wherein stabilizing the coring tool utilizing the stabilizer comprises stabilizing the coring tool utilizing the stabilizer, an outer diameter of the stabilizer being about 0.125 inch or less smaller than an outer diameter of the coring bit at the outer gage of the cutting structure.

17. The method of claim 15, further comprising flowing drilling fluid between blades of the stabilizer, the blades extending at least substantially parallel to a longitudinal axis of the coring tool.

18. The method of claim 15, further comprising selectively, radially extending the at least one blade of the stabilizer to reduce a distance between the at least one blade and a wall of the borehole.

19. The method of claim 15, wherein stabilizing the coring tool utilizing the stabilizer comprises stabilizing the coring tool utilizing the stabilizer integrated into the outer barrel of the coring tool, such that the stabilizer is located within a longitudinal extent of the outer barrel of the coring tool.

20. The method of claim 15, wherein stabilizing the coring tool utilizing the stabilizer comprises stabilizing the coring tool utilizing the stabilizer forming part of a distinct sub attached to the coring tool, such that the stabilizer is located above a longitudinal extent of the coring tool.

* * * * *